US010189619B1

(12) United States Patent
Crawley

(10) Patent No.: US 10,189,619 B1
(45) Date of Patent: Jan. 29, 2019

(54) LOCKABLE FOOD CONTAINER

(71) Applicant: Caren Crawley, Bronx, NY (US)

(72) Inventor: Caren Crawley, Bronx, NY (US)

( * ) Notice: Subject to any disclaimer, the term of this patent is extended or adjusted under 35 U.S.C. 154(b) by 348 days.

(21) Appl. No.: 15/064,120

(22) Filed: Mar. 8, 2016

Related U.S. Application Data

(63) Continuation-in-part of application No. 13/851,743, filed on Mar. 27, 2013.

(51) Int. Cl.
*B65D 43/18* (2006.01)
*B65D 51/18* (2006.01)
*B65D 55/14* (2006.01)

(52) U.S. Cl.
CPC ..... *B65D 55/145* (2013.01)

(58) Field of Classification Search
CPC ..... B65D 45/16; B65D 45/20; B65D 45/24; B65D 45/18; B65D 55/145
USPC ..... 206/1.5, 541; 215/2, 207, 215, 230, 356; 220/210, 212, 254.1, 254.3, 254.6, 254.8, 220/256.1, 259.1, 259.3, 244, 290–291, 220/325, 324, 541, 592.2, 592.27
See application file for complete search history.

(56) References Cited

U.S. PATENT DOCUMENTS 2,415,767 A 2/1947 Shaw
2,578,089 A 12/1951 Piker
2,595,113 A 1/1952 Taberer
3,093,238 A 6/1963 King
3,331,522 A 7/1967 Bridges
4,852,725 A 8/1989 Folsom
5,094,363 A 3/1992 Monahan
5,251,542 A * 10/1993 Itoh ..... A47J 36/10 206/545
D356,469 S 3/1995 Musilli et al.
5,427,265 A 6/1995 Cautereels et al.
D364,320 S 11/1995 Sipe
D376,979 S * 12/1996 Davidson, III ..... D9/504
5,590,801 A 1/1997 Cohen
5,598,792 A 2/1997 Wales
6,003,718 A 12/1999 Lu
7,866,505 B2 1/2011 Perlman et al.
8,938,999 B2 1/2015 Dahl
2005/0097931 A1 5/2005 Miller
2005/0161455 A1 7/2005 Studee
2005/0263411 A1 12/2005 Harrington
2006/0108364 A1 5/2006 Benktzon
2007/0228042 A1 * 10/2007 Yeager ..... B65D 47/0804 220/254.3
2009/0078607 A1 3/2009 Ballard

* cited by examiner

*Primary Examiner* — Anthony Stashick
*Assistant Examiner* — Kaushikkumar Desai

(57) ABSTRACT

The present invention features a portable food container with lockable top cover. The portable food container comprises a base and a top cover. The top cover is lockable via a combination dial with at least two numbers. The top cover is attached to the base via a separable hinge such that the top cover can be removed from the base when the top cover is unlocked. The base and the top cover are engaged together via a thread means, or a hinge lock.

1 Claim, 2 Drawing Sheets

LOCKABLE FOOD CONTAINER

CROSS REFERENCE

This application claims priority and is a continuation-in-part to U.S. patent application Ser. No. 13/851,743, filed Mar. 27, 2013, the specification(s) of which is/are incorporated herein in their entirety by reference.

FIELD OF THE INVENTION

The present invention is related to a portable Food container, especially related to a portable food container with a combination locked cover.

BACKGROUND OF THE INVENTION

Portable Food containers are widely used for various areas including group activities such as a group sport game, wherein people bring their own food/drink in a container and usually put their food container together. Most food containers are sealed by zippers or threaded covers, both of which can be easily opened and thus vulnerable for privacy pry or sometimes mistakenly taken by other people. Therefore, there is a need for a portable food container with lockable lid or cover.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a portable food container with lockable top cover. The portable food container comprises a base and a top cover. The top cover is lockable via a combination lock with at least two numbers. The top cover is attached to the base via a separable hinge such that the top cover can be removed from the base when the top cover is unlocked. The base and the top cover are engaged together via a thread means, or a hinge lock.

DESCRIPTION OF PREFERRED EMBODIMENTS

Figure 1:
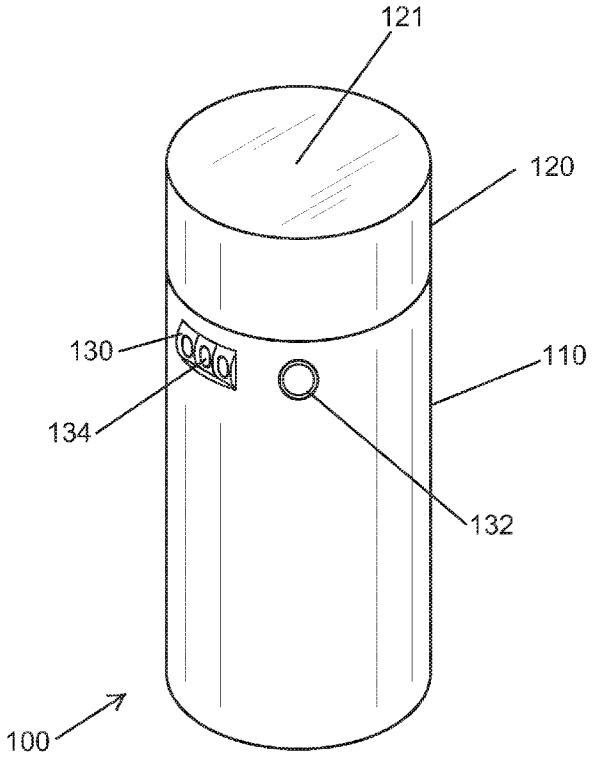
FIG. 1 shows an isometric view of the lockable food container.

Following is a list of elements corresponding to a particular element referred to herein:

100 food container system
110 base
112 upper end of the base
1112 first outer edge of the upper end of the base
2112 second inner edge of the upper end of the base
113 top opening
114 first lock slot
115 lateral surface of the base

Figure 2:
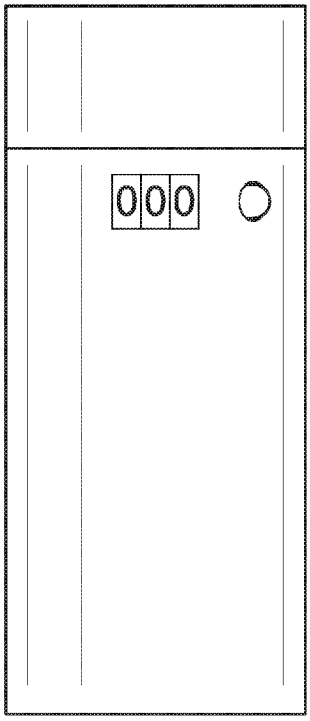
FIG. 2 shows a front view of the lockable food container.
Figure 3:
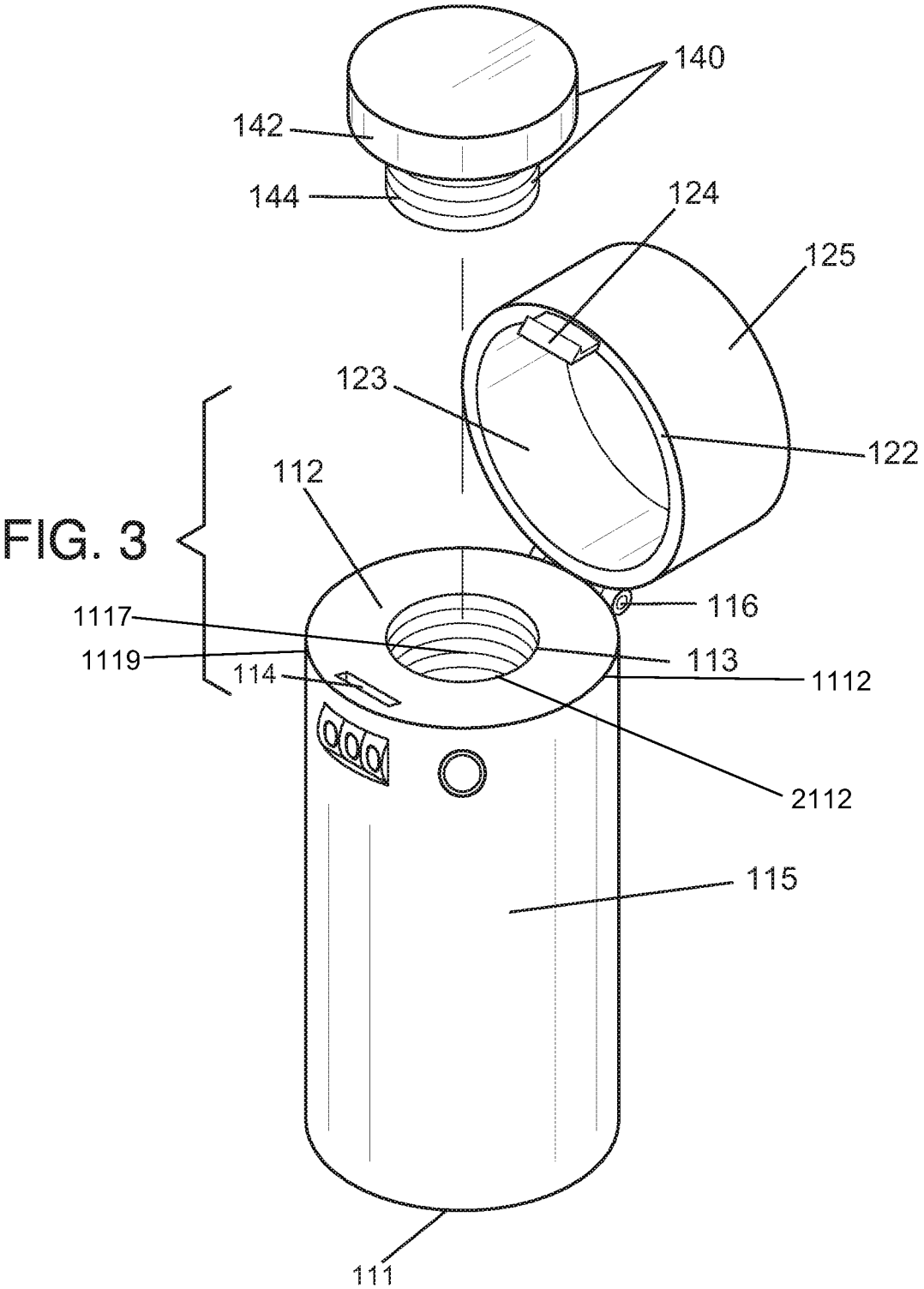
FIG. 3 shows an exploded view of the lockable food container.

116 separable hinge
120 first top cover
121 first top cover upper surface
122 first top cover lower opening rim
123 first top cover lower opening
124 first lock insertion
125 first cover lateral surface
130 combination dial
132 lock release button
134 combination lock character
140 inner cover
142 inner cover upper section
144 threaded rod of the inner cover
1117 internal cavity wall
1119 outside wall disposed on the base lateral surface Referring now to FIGS. 1-3, the present invention features a portable food container system (100) with lockable top cover.

In an embodiment, the portable food container system (100) comprises a base (110), a first top cover (120) and a combination lock system. The cylindrical base (110) has a lower end (111), an upper end (112) and a base lateral surface (115), wherein a top opening (113) is disposed on the upper end (112).

In some embodiments, the upper end (112) of the cylindrical base comprises the first outer edge (1112) and the second inner edge (2112). In some embodiments, as shown in FIG. 3 of the present invention, an internal cavity wall (1117) extends continuously and outwardly to join the second inner edge (2112) of the upper end (112) of the base, continues further outwardly to join the first outer edge (1112) of the upper end (112) of the base and continues to extend further to join an outside wall (1119) disposed on the base lateral surface (115) without any spacial break. In some other embodiments, the surface of the internal cavity wall (1117) is internally threaded.

In one preferred embodiment, a space between the internal cavity wall (1117) and the outside wall (1119) is evacuated of air and a vacuum is generated which is effective to maintain an initial temperature of food contained inside the food container (100) for longer period of time as compared to prior art (U.S. Pat. No. 6,003,718) food containers where no such vacuum space is generated. This feature of having a vacuum between the connected at the top internal cavity wall (1117) and the outside wall (1119) in the present invention is uniquely different over Lu prior art (U.S. Pat. No. 6,003,718). As shown in FIG. 2 in Lu patent, a thermos with a tapered outer body (10) is disclosed which contains two separate glass liners (32). The outside wall of the tapered outer body (10) is not continuously attached with the inner surface of the separate glass liners (32). In other words, there is spacial break between the outside wall of the tapered outer body (10) and the inner surface of the separate glass liners (32) in Lu prior art. The clear disadvantage of the disconnected outside wall (10) and the wall of the inside glass liners (32) is that the generation of a vacuum filled space is not possible between the outside wall (10) and the surface of the inner glass liners (32). In consequence, the Lu prior art cannot eliminate the presence of outside air in between two disconnected outside and inside wall surfaces (10, 32) which would eventually result in faster heat escape from the food as disclosed in FIG. 2 of Lu prior art.

In some embodiments, the cylindrical first top cover (120) has an upper surface (121), a lower surface comprising a lower surface opening (123) surrounded by a lower opening rim (122), and a first cover lateral surface (125), wherein the first top cover (120) is pivotably and removably attached to the base via a separable hinge (116), wherein the separable hinge (116) is configured to connect a portion of the base lateral surface (115) adjacent to a portion of the base upper end (112) to the first cover lateral surface (125) adjacent to the lower opening rim (122).

In some embodiments, the system further comprises an inner cover (140) comprising an inner cover upper section (142) and an externally threaded rod (144) disposed beneath the inner cover upper section (142), wherein the threaded rod (144) is configured to engage the top opening (113) and is configured to be threadably disposed on the internally threaded surface of the internal cavity wall (1117) of the cylindrical base (110). The feature of threadable disposition of rod (144) directly onto the threaded surface of the internal cavity wall (1117) is also different over Lu prior art (U.S. Pat. No. 6,003,718). As shown in FIG. 3 in Lu patent, the internal cavity walls of the glass liners (32) are not threaded. Instead, a peanut shaped enclosure (20) connects the opening of the glass liners with the inner cap (40) via an O-shaped additional threaded collar (26) and a silicon gasket (30). The disadvantage of not having threading on the neck of the glass liners (32) and the presence of additional connecting joints to connect the glass liners (32) with the inner cap (40) is that the Lu glass liners (32) are not as effective to reduce heat escape from food contained inside the container as compared to the present invention where the threaded rod is directly connected to the internal cavity wall (1117) of the cylindrical base (110). The presence of additional connecting joints will make the system in Lou patent (U.S. Pat. No. 6,003,718) more susceptible to heat transfer with the outside atmosphere.

In some embodiments, in the present invention, the inner cover upper section (142) resides within the first top cover (120) when the first lock insertion (124) is locked within the first lock slot (114).

In some embodiments, the cylindrical first top cover (120) engages the first outer edge (1112) of the upper end (112) of the base and the inner cover upper section (142) engages the second inner edge (2112) of the upper end (112) of the base; wherein a single engaging surface of the upper end (112) of the base engages with the cylindrical first top cover (120) and the inner cover upper section (142). The feature of a single engaging surface of the upper end (112) of the base is uniquely different over Lu prior art (U.S. Pat. No. 6,003,718). As shown in FIG. 4 in Lu patent, the outside top cover (50) engages the outside surface (10) and an inside second cover (42) engages the O-shaped collar (26) disposed on the opening (24) of the separate glass liners (32) present inside the outside surface (10). Therefore, the outside top cover (50) and the inside second cover (42) act on two different surfaces in Lou prior art. The disadvantage of having two different engaging surfaces for the outside top cover (50) and the inside second cover (42) is that the covers are less efficient to eliminate the possibility of heat transfer with the outside atmosphere because of the presence of additional spaces in between the covers and as a result heat escape from the food contained inside will be faster in Lu prior art as compared to the present invention where a single engaging surface of the upper end (112) of the base engages with the cylindrical first top cover (120) and the inner cover upper section (142).

In some embodiments, the present invention discloses the combination lock system comprising (i) a combination dial (130) disposed on the lateral surface (115) of the base toward the upper end (112); (ii) a first lock slot (114) disposed on the upper end (112) adjacently above the combination dial (130); (iii) a first lock insertion (124) disposed on the lower opening rim (122) and on the opposite side facing the separable hinge (116); (iv) a lock release button (132) disposed on the base lateral surface (115) adjacent to the combination dial (130). The first lock slot (114) is configured to snugly receive the first lock insertion (124) and securely lock the first lock insertion (124) within the first lock slot (114); wherein the lock release button (132) is operatively connected to the combination dial (130), wherein the lock release button (132) is configured to disengage the first lock insertion (124) from the first lock slot (114) after a predetermined combination key is selected and after the lock release button (132) is pushed.

The feature of locking mechanism of the presently claimed invention is clearly different over Perlman prior art (U.S. Pat. No. 7,866,505 B2). The Perlman prior art disclosed in FIG. 5 a lockable storage container (10) with a lid (20), base (30) and a locking mechanism (50) wherein the lid (20) and the base (30) do not have any component equivalent to the feature of the cylindrical first top cover (120) and the cylindrical base (110) of the presently claimed invention. The Perlman prior art demonstrated in FIG. 5 that in order to function the locking mechanism (50), the access aperture (52) should be aligned with the lid aperture (21) and when that alignment is attained, the locking end portion (62) of the securing cable (60) is passed through the lid aperture (21) and the access aperture (52) to lock the lid (20) on top of the base (30). In contrast, the presently claimed invention disclosed in FIG. 3 that the first lock slot (114), which is disposed on the upper end of the base (112), is configured to snugly receive the first lock insertion (124), which is disposed on the lower opening rim (122), and securely lock the first lock insertion (124) within the first lock slot (114). The locking feature disclosed in the presently claimed invention is more user friendly, easier to operate and unique over Perlman prior art.

In some embodiments, the combination dial (130) requires a predetermined permutation of at least three combination lock characters (134) to unlock, wherein the combination lock characters (134) are numbers or letters. The combination lock is well known to one with ordinary art in the field.

The disclosures of the following U.S. Patents are incorporated in their entirety by reference herein: U.S. Pat. No. 2,415,767, U.S. Pat. No. 2,578,089, U.S. Pat. No. 5,427,265, U.S. Pat. No. 5,590,801, U.S. Design Pat. USD35649, U.S. Design Pat. USD36430, U.S. Patent Application Publication 2005/0097931, U.S. Patent Application Publication 2005/0161455 and U.S. Patent Application Publication 2005/0263411.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable food container system (100), said system comprising:

(a) a cylindrical base (110) with a lower end (111), an upper end (112) and a base lateral surface (115), wherein a top opening (113) is disposed on the upper end (112), wherein the upper end (112) of the cylindrical base comprises a first outer edge (1112), a second inner edge (2112), and an annular surface (3112) disposed between the first outer edge (1112) and the second inner edge (2112);

(b) a first lockable, cylindrical top cover (120) with an upper surface (121), a lower surface comprising a lower surface opening (123) surrounded by a lower opening rim (122), and a first cover lateral surface (125), wherein the first top cover (120) is pivotably and removably attached to the base via a separable hinge (116), wherein the separable hinge (116) is configured to connect a portion of the base lateral surface (115) adjacent to a portion of the base upper end (112) to the first cover lateral surface (125) adjacent to the lower opening rim (122);

(c) a combination lock system comprising (i) a combination dial (130) disposed on the lateral surface (115) of the base toward the upper end (112); (ii) a first lock slot (114) disposed on the annular surface (3112) of the upper end (112) adjacently above the combination dial (130); (iii) a first lock insertion (124) disposed on the lower opening rim (122) and on the opposite side facing the separable hinge (116); and (iv) a lock release button (132) disposed on the base lateral surface (115) adjacent to the combination dial (130), wherein the first lock slot (114) is configured to snugly receive the first lock insertion (124) and securely lock the first lock insertion (124) within the first lock slot (114), wherein the lock release button (132) is operatively connected to the combination dial (130), wherein the lock release button (132) is configured to disengage the first lock insertion (124) from the first lock slot (114) after a predetermined combination key is selected and after the lock release button (132) is pushed;

(d) an internal cavity wall (1117) joining the second inner edge (2112) of the upper end (112) of the base such that the internal cavity wall (1117) transitions to the annular surface (3112), and the annular surface (3112) transitions to an outside wall (1119) disposed on the base lateral surface (115), wherein the transition of the internal cavity wall (1117) to the annular surface (3112) to the outside wall (119) is continuous and is without any spacial break other than the first lock slot (114) disposed on the annular surface (3112), wherein an inside space between the internal cavity wall (1117) and the outside wall (1119) is evacuated of air and a vacuum is generated which is effective to maintain an initial temperature of food contained inside the food container (100), wherein a surface of the internal cavity wall (1117) is internally threaded; and (e) an inner cover (140) comprising an inner cover upper section (142) and an externally threaded rod (144) disposed beneath the inner cover upper section (142), wherein the externally threaded rod (144) is configured to engage the top opening (113) and is configured to threadably dispose on the internally threaded surface of the internal cavity wall (1117) of the cylindrical base (110) and is effective to reduce heat escape from food contained inside the cylindrical base (110);

wherein the inner cover upper section (142) resides within the first top cover (120); wherein the cylindrical first top cover (120) engages the first outer edge (1112) of the upper end (112) of the base and the inner cover upper section (142) engages the second inner edge (2112) of the upper end (112) of the base; wherein the annular surface (3112) of the upper end (112) of the base engages with the cylindrical first top cover (120) and the inner cover upper section (142) and is effective to maintain an initial temperature of food contained inside the cylindrical base (110).

* * * * *